US010006750B2

(12) United States Patent
Birkin et al.

(10) Patent No.: US 10,006,750 B2
(45) Date of Patent: Jun. 26, 2018

(54) BLASTING SYSTEM CONTROL

(71) Applicant: DETNET SOUTH AFRICA (PTY) LTD (ZA), Woodmead (ZA)

(72) Inventors: Christopher Malcolm Birkin, Woodmead (ZA); Riaan Van Wyk, Woodmead (ZA); Andre Koekemoer, Woodmead (ZA); Trevor Watt, Woodmead (ZA)

(73) Assignee: DETNET SOUTH AFRICA (PTY) LTD (ZA), Woodmeed (ZA)

( * ) Notice: Subject to any disclaimer, the term of this patent is extended or adjusted under 35 U.S.C. 154(b) by 0 days. days.

(21) Appl. No.: 15/103,419

(22) PCT Filed: Dec. 9, 2014

(86) PCT No.: PCT/ZA2014/000071

§ 371 (c)(1),
(2) Date: Jun. 10, 2016

(87) PCT Pub. No.: WO2015/089524

PCT Pub. Date: Jun. 18, 2015

(65) Prior Publication Data

US 2016/0313107 A1 Oct. 27, 2016

(30) Foreign Application Priority Data

Dec. 12, 2013 (ZA) ..... 2013/09366

(51) Int. Cl.

| | |
|---|---|
| ***F42D 3/04*** | (2006.01) |
| ***F42D 1/055*** | (2006.01) |
| *F42D 1/00* | (2006.01) |

(52) U.S. Cl.
CPC ..... *F42D 3/04* (2013.01); *F42D 1/055* (2013.01); *F42D 1/00* (2013.01)

(58) Field of Classification Search
CPC ... F42D 1/00; F42D 1/05; F42D 1/055; F42D 3/00; F42D 3/04; F42D 3/06
USPC ..... 102/301, 302, 311, 312, 313, 206, 215
See application file for complete search history.

(56) References Cited

U.S. PATENT DOCUMENTS

| | | | | |
|---|---|---|---|---|
| 6,772,105 | B1 | 8/2004 | Heck, Sr. | |
| 6,941,870 | B2 * | 9/2005 | McClure | F42D 1/055 102/311 |
| 7,650,841 | B2 * | 1/2010 | McClure | F42D 1/055 102/311 |

(Continued)

FOREIGN PATENT DOCUMENTS

| | | |
|---|---|---|
| WO | 00/04337 | 1/2000 |

OTHER PUBLICATIONS

Written Opinion of the International Searching Authority for Application No. PCT/ZA2014/000071, dated Jul. 21, 2015 (5 pages).

(Continued)

*Primary Examiner* — James S Bergin
(74) *Attorney, Agent, or Firm* — Michael Best & Friedrich LLP

(57) ABSTRACT

A method of implementing a blasting system wherein positional information relating to a blast site is generated by a device which inputs the information to a processor which generates information pertaining to the location of each potential borehole at the site and that information is used by the device to indicate the location of each borehole to an operator.

5 Claims, 2 Drawing Sheets

(56) References Cited

U.S. PATENT DOCUMENTS

| | | | | |
|---|---|---|---|---|
| 7,707,939 | B2 * | 5/2010 | Brent | F42D 3/04 102/312 |
| 8,256,349 | B2 * | 9/2012 | Moore | F42D 3/04 102/301 |
| 2005/0103219 | A1 | 5/2005 | McClure et al. | |
| 2011/0083574 | A1 | 4/2011 | Levan et al. | |
| 2014/0026775 | A1 * | 1/2014 | Papillon | F42D 1/055 102/215 |

OTHER PUBLICATIONS

International Search Report for Application No. PCT/ZA2014/000071, dated Jul. 21, 2015 (3 pages).

* cited by examiner

BLASTING SYSTEM CONTROL

BACKGROUND OF THE INVENTION

This invention relates generally to a process for controlling the planning and implementation of a blasting system.

Blasting systems vary substantially inter alia in respect of the techniques and technologies which are employed. A large mining operation for example will typically make use of electronic detonators and software-based design systems. However, in a relatively small mine of quarry, this type of approach may not be justified. There may also be a shortage of personnel who are sufficiently qualified or who are prepared to make use of a high level approach in planning and implementing a blasting system.

As a consequence many small mines and quarries operate on basic systems and do not make use of the complex and sophisticated techniques which are available and which are generally used in large scale mining and rock breaking applications.

Consequently, to a substantial extent the planning of a blasting system in a small mine is based on experience and generic factors. Typically an area of a blast bench is surveyed, and marked by a planner or surveyor. Subsequently a blast planning and design process is carried out by a blaster who proceeds on the basis of experience and knowledge of blasts previously conducted at the site to achieve desired results in respect of overburden removal, fragmentation of an ore body e.g. a coal seam, fragmentation of rock and so on.

In many instances there is no predetermined blast plan. Borehole locations are often determined on a "best guess" basis and are marked using rudimentary procedures such as tape measures, guide ropes, pacing of distances etc. The borehole locations are marked and, subsequently, a blaster manually directs a drill rig to each hole location.

Some hole locations, may be altered, or added to an initial system, depending on the outcome of boreholes which have been drilled. Manual observations are made with drill, swarf and the depth of each borehole is manually checked to establish some guideline of satisfactory process. Detonators and boosters, depending from shock tubes, are placed at an appropriate depth in the individual boreholes. Typically each shook tube is secured at ground level with the detonator and booster suspended from the shock tube. A suitable quantity of explosive emulsion is pumped from a delivery vehicle into each borehole. Manual techniques are used to ensure that the borehole has been correctly charged with the emulsion. Thereafter the emulsion is left to gas and, once the emulsion has solidified, the quantity of the explosive in each borehole is again cheeked. As may be appropriate, additional emulsion is added, whereafter stemming, in the form of swarf, is placed over the emulsion in the borehole. Stemmed holes are then interconnected to achieve a desired blast layout. Wiring to an initiating point takes place and the blast is ready.

It is apparent from the aforegoing that the establishment of a blasting system in this way is almost wholly dependent on experience and manually implemented techniques and, inevitably, is prone to human error. Nonetheless due to a variety of factors the use of more sophisticated techniques may not be justifiable.

Problems which are associated with the aforegoing include the following:

a) a variation in the process, or the omission of a stage, can compromise the blast result and pose operational and safety risks;

b) blasts are not necessarily optimized to achieve maximum rock displacement or breakage; and c) processes are not normally well documented and there may be little or no correlation between outcome and intent.

Consequently, although a small operation may be functioning under tight financial constraints, an inefficient outcome of a manually planned and implemented blasting system can compound operational and financial pressures.

An object of the present invention is to provide a method of planning and implementing a blasting system which, to a substantial extent, can address the aforementioned factors and which does not make use of sophisticated electronic blasting and software-based design systems.

SUMMARY OF THE INVENTION

The Invention provides a method of planning and implementing a blasting system which is to include a plurality of boreholes, the method including the steps of:

1) providing a device which generates locational information;
2) providing a processor;
3) using the device to determine positional information relating to a boundary of a blast site;
4) inputting parameters relating to the blasting system and the positional information into the processor;
5) using the processor to generate locational information relating to the location of each borehole in the blast site; and
6) using the device to indicate the location of each borehole to an operator.

The invention can be implanted in different ways. At a blasting site or bench boreholes may already be drilled. The locations of the boreholes may then be determined and validated against locations indicated in step (6) and a blasting plan can then be generated using the validated locational information of the boreholes as an input parameter.

In a different form of the invention boundaries of the blast site are identified in step (3). Locational information for a plurality of boreholes within the boundaries, is generated in step (5) and the boreholes are then drilled at the respective locations.

In each of these examples the blasting plan is thus effectively adapted to seek the prevailing geographical or geometrical constraints which are applicable.

The method may further allow for a blaster, at each borehole, to input information into the processor to record information relating to that borehole such as its location; its depth; the time taken to drill the borehole; information on the machine or person doing the drilling; the type and number of detonators and boosters placed in the borehole; the depth, in the borehole, of each detonator; the time taken to pump an emulsion into the borehole; the quantity of emulsion in the borehole, the nature of stemming placed into the borehole, and so on. These features or characteristics are exemplary only and are non-limiting. An intention in this respect is that all relevant information which could affect the actual blasting process and, in particular, its efficiency, can be recorded.

Additionally, essential information which should be recorded in respect of a borehole, can be prompted to the blaster. Thus the processor may present a plurality of requests which must be responded to by a blaster and, only once all required information, determined by a program executed by the processor, has been supplied to the processor, will the processor indicate and record that all of the blasting requirements pertaining to a particular borehole have been met.

It also falls within the scope of the method of the invention for the processor to validate information which is input by the blaster, in accordance with reference information. Input information which is not acceptable can be flagged to the blaster so that remedial action can be taken. The input information can relate to the date, time and location of the intended blast, the identity of the blaster and any other information required from a security or technical aspect to ensure that the blast is effectively implemented.

The locational device may be a GPS. The processor may be a handheld mobile apparatus. It is possible for the processor and the locational device to be combined into an integral unit. For example, use may be made of a so-called smartphone which offers a computational capability and into which is integrated a locationing system such as a GPS. The use of a GPS as a ideational device is exemplary only and non-limiting. Other locational devices are known in the art. One device which may find particular application in the implementation of the method of the invention is a wireless system which generates relative locational information. It is observed in this connection that a GPS typically generates absolute locational information. This type of information is not necessarily required in the application of the present invention in that, what is important, are the relative locations of the boreholes at a site which is to be blasted.

A program executed within the smartphone may be resident in the smartphone. Alternatively the program may be remote e.g. in a cloud system. Various other techniques which are known in the art may be used for this purpose. The invention is not restricted in this regard.

BRIEF DESCRIPTION OF THE DRAWINGS

The invention is further described by way of example with reference to the accompanying drawings in which.

DESCRIPTION OF PREFERRED EMBODIMENT

The invention is based oh the provision of a basic interface to a software application, which assists, plans, guides and records details of various stages required to achieve a successful blast. Additionally the application offers a reference database to record, analyze and validate various aspects of each such stage.

Typically use is made of a cellular telephone or similar interface device which may incorporate a locationing system or which otherwise is coupled to a separate locationing system such as a GPS. A GPS is capable of generating absolute locational information. What is important in applying the principles of the invention is information relating to the relative locations of the boreholes in a proposed blasting system. Wireless positional indicators, known in the art, can be used to generate information which reflects the relative locations of a plurality of boreholes which have already been drilled at a blasting site. The locationing device should be accurate, at least, to within about 1 meter but preferably to about 10 cm.

In implementing the method of the invention use is made of a program which may be resident in the interface device or which is accessible wirelessly. For example appropriate software may be stored in a remote device which is accessible wirelessly and which may be cloud based. Communication techniques to input information to this type of application and to present the results produced by the running of the software are known in the art and are not further described herein.

An important aspect of the invention is that the positioning device and the processing capability should be readily mobile so that a blaster can implement the blasting system with ease. Further, the level of expertise required of a blaster to make use of the method of the invention should not call for high level skills or knowledge in respect of computer systems.

Figure 1:
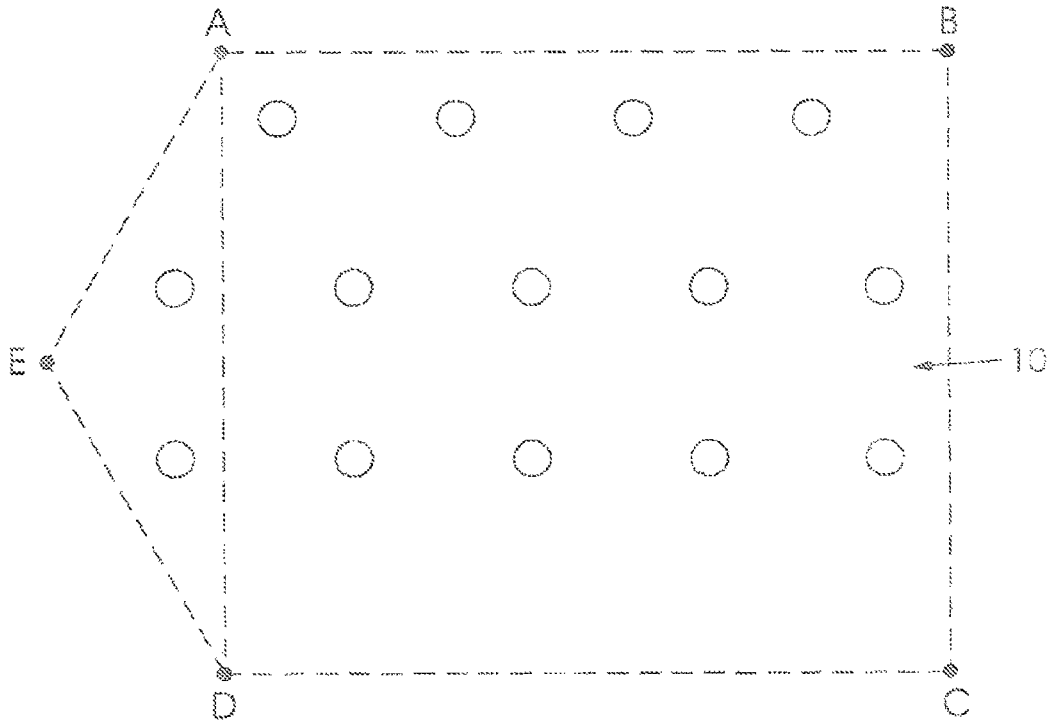
FIG. 1 is a plan view of a blast site in which the method of the invention is implemented.

FIG. 1 illustrates a blast site 10 with boundary points A, B, C, D and E. These boundary points, if represented by X and Y coordinates, accurately define the area, within the boundaries, of the blast site 10.

A blaster could, by taking the mobile device to each boundary point, record the coordinates of that point and in this way determine the boundaries of the site. Alternatively, it is possible for the blaster to enter coordinates into the application software and the software would then have a record of the extent of the blast site. In general terms therefore the boundaries of the proposed blast site could be determined in an absolute sense. Alternatively, by using the location of one boundary point as a reference location all of the boundary points of the proposed blast site can be determined relative to the chosen location.

Figure 3:
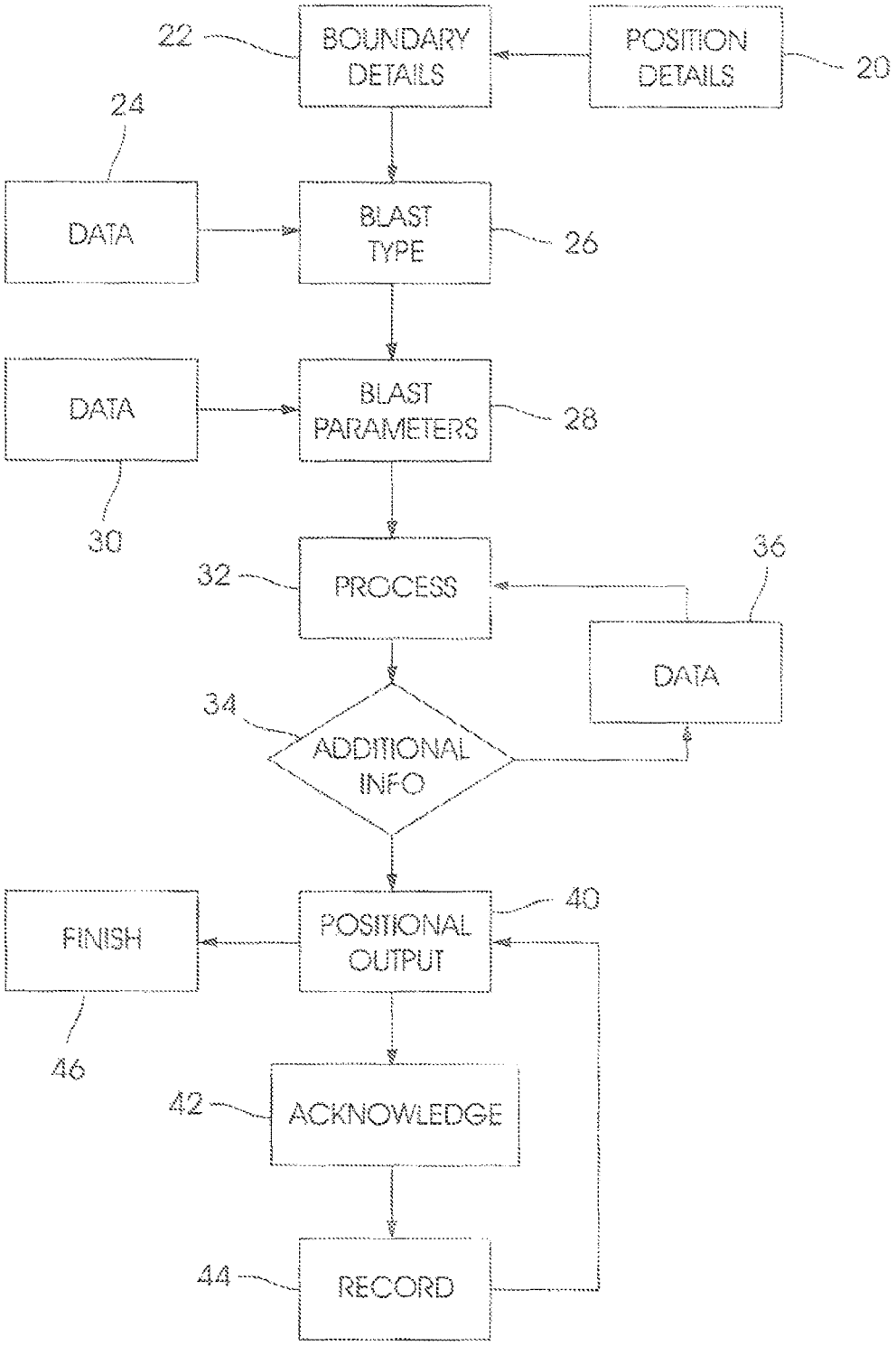
FIG. 3 is a flow chart depicting various steps which are carried out when the method of the invention is implemented.

FIG. 3 depicts a situation in which a blaster inputs locational data 20 into the device which then records boundary details of the blast site 10 (step 22).

The device then prompts the blaster to enter data 24 relating to a selected blast type 26. Subsequently the blaster is called upon (step 28) to enter data 30 relating to blast parameters applicable to the blast site. The requests in this respect are presented sequentially and for example, could encompass factors such as hole depth, burden, inter-hole and inter-row spacing of boreholes, a time delay of each detonator, a detonator hookup pattern, and so on. Generally the blaster is experienced in the provision of this type of information. However, through the use of the software, the blaster is prompted to make a positive decision in respect of each parameter and additionally, the software ensures that all parameter requests are responded to.

Data relating to the blast layout is then processed (step 32) by the processor. If additional information is requested by the processor (step 34) then the blaster must input relevant data 36 to enable the calculation exercise to be carried out.

Use is made of proprietary blasting design software which is executed in the interface device or externally, as described, to process the information and to compute, and finally present, a blast plan. Thereafter, the blaster is guided by the positioning device to the location of each borehole (40). When the blaster is at a designated location for a particular borehole, he is prompted to acknowledge this to the system (42).

Figure 2:
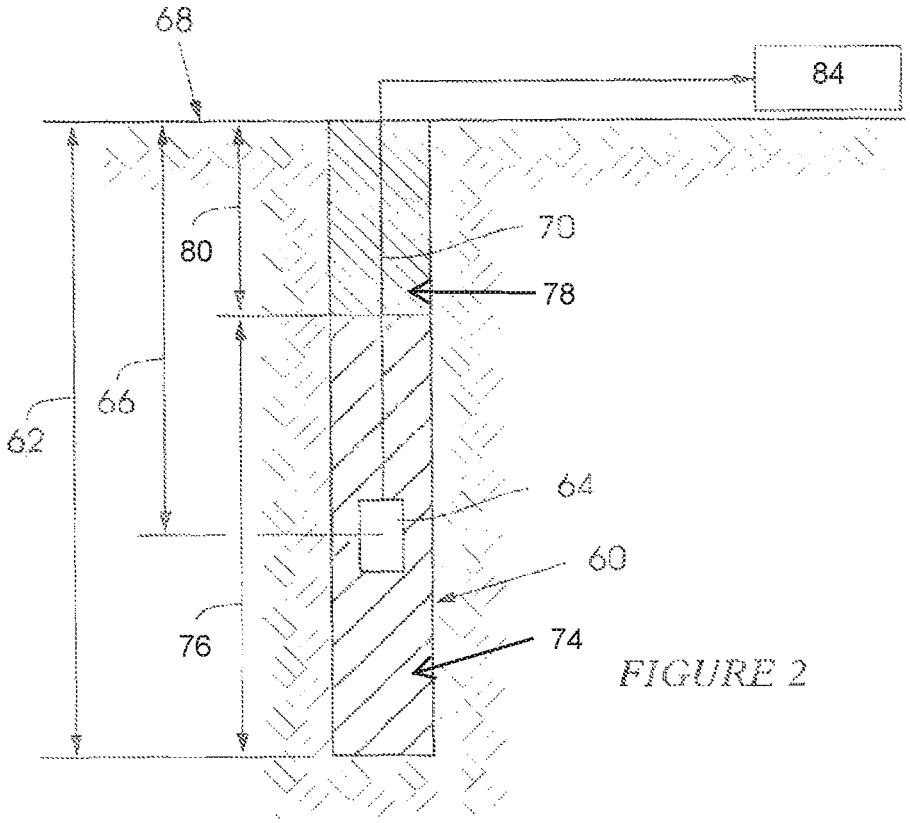
FIG. 2 depicts, in cross-section, a borehole which is one of a plurality of boreholes at the blast site.

The blaster then enters into the system information relating to the borehole. FIG. 2 illustrates an exemplary borehole 80, the essential characteristics of which are then determined by the system during a step 44. In this step a plurality of requests are presented to the blaster. For each request specific information must be input. The information relates, inter alia, to the depth 62 of the borehole, the time taken to drill the borehole, information on a detonator and booster 64 placed into the borehole, the depth 66, from ground level 68, at which the detonator and booster are suspended by means of a shock tube 70, the quantity of explosive emulsion 74 pumped into the hole—this may be recorded by the length 78 of the emulsion in the hole taken from the base of the borehole and, finally, that stemming 78, for example in the nature of swarf, is placed into the borehole over the explosive to a depth 80.

Although these different steps and aspects are well-known to an accomplished blaster a function of the system is to ensure that an accurate relevant record is kept thereof and, additionally, the blaster is required to make a positive statement on each characteristic. The software thus ensures that all relevant aspects are brought to the attention of the blaster.

Once the installation procedures at each borehole have been correctly effected this is acknowledged by the blaster (step 46). Thereafter connections between the detonators and a blasting machine 84 are made in an appropriate manner, and blasting can take place in accordance with other procedures.

In the preceding example it is envisaged that the positional parameters of the boundaries of an intended blast site are input into the system and, arising therefrom, information which defines the location of each borehole, to be used in the system, is generated. It is quite possible though that boreholes are initially drilled at an intended blast site and, thereafter, that the location of each borehole is determined either on an absolute or on a relative basis. This locational information is then input to the software which, by using a set of best practice rules, for example, can then generate details of the way in which the blasting system should further be implemented. For example, a blaster may designate borehole locations in accordance with a predetermined and accepted procedure but, nonetheless, the boreholes might be drilled "off-location". The method of the invention can then take into account those boreholes which are not precisely located and implement procedures to overcome deviations of this kind.

Specific parameters which pertain to each borehole may include timing delays for the initiation of each explosive, stacking requirements where multiple detonators are used in a single borehole, the quantity of each explosive, typically an emulsion explosive, placed into a borehole, the density of the explosive and so on. Electronic detonators which are programmable in respect of time delays can be employed or, if electronic detonators are not used, appropriate delay devices can be chosen from a set of standardized delay devices.

A further benefit of the invention lies in the capability that the results of a blast can be recorded and correlated to the input or control parameters. After a blast has taken place a blaster or other person can be tasked to answer a series of questions which are designed to assess the effectiveness of the blast e.g. the degree of rock fragmentation which has taken place, the nature of the rock blasted, the quantity of explosive used in each borehole, the nature of the explosive used, and so on. These are exemplary aspects only. The effectiveness of the blast can then be related to factors which specify the nature of the blast. A form of feedback can therefore be established which allows historical data to be accumulated. Decisions based thereon can then be taken to set up details of a succeeding blast.

A significant benefit of the invention lies in the fact that use is made of a simple handheld device which offers positioning and computational capabilities. The device executes proprietary software in a regulated and controlled manner to ensure that all relevant steps pertaining to the design and implementation of a blasting system are successfully carried out, and recorded.

The invention claimed is:

1. A method of planning and implementing a blasting system which is to include a plurality of boreholes, the method including the steps of:

1) providing a device which generates positional information;
2) providing a processor;
3) prior to installing detonators in the plurality of boreholes, using the device to determine positional information relating to a boundary of a blast site;
4) prior to installing detonators in the plurality of boreholes, inputting parameters relating to the blasting system and the positional information into the processor;
5) prior to installing detonators in the plurality of boreholes, using the processor to generate locational information relating to the location of each borehole in the blast site;
6) prior to installing detonators in the plurality of boreholes, using the device to indicate the location of each borehole to an operator;
7) using the processor to prompt a blaster, in respect of each borehole, to ensure that all the parameters relating to the blasting system and the positional information have been input into the processor and, only once all the parameters relating to the blasting system and the positional information, determined by a program executed by the processor, have been supplied to the processor, does the processor record that all of the blasting requirements of a particular borehole have been met; and
8) using the processor to validate said parameters which have been input and which are required from a security or a technical aspect, to ensure that the blast is effectively implemented; characterized in that said parameters relate to data which are selected from data which record in respect of each borehole: its location; its depth; the time taken to drill the borehole; information data on a machine or person doing the drilling; the type and number of detonators and boosters placed in the borehole; the depth, in the borehole, of each detonator; the time taken to pump an emulsion into the borehole; the quantity of emulsion in the borehole; and the nature of stemming placed in the borehole; and characterized in that the device and the processor are separate from the detonators.

2. A method according to claim 1 which is implemented at a site at which boreholes have already been drilled, wherein the locations of the drilled boreholes are validated against the locations indicated in step 6 and a blasting plan is then generated using the validated locational information of the boreholes as an input parameter.

3. A method according to claim 2 wherein, in step 3, the positional information is absolute or relative positional information.

4. A method according to claim 1 wherein boundaries of the blast site are determined in step 3 and, within the boundaries, locational information for a plurality of boreholes is generated in step 5, and the boreholes are then drilled at the respective locations.

5. A method according to claim 1 wherein, in step 3, the positional information is absolute or relative positional information.

* * * * *